United States Patent [19]

Lauterbach et al.

[11] Patent Number: 4,781,530

[45] Date of Patent: Nov. 1, 1988

[54] COMPRESSOR RANGE IMPROVEMENT MEANS

[75] Inventors: Jerre F. Lauterbach; James D. Kahlenbeck; Bruce W. Turner, all of Columbus, Ind.

[73] Assignee: Cummins Engine Company, Inc., Columbus, Ind.

[21] Appl. No.: 889,633

[22] Filed: Jul. 28, 1986

[51] Int. Cl.[4] ..... F04D 29/44

[52] U.S. Cl. ..... 415/170 R; 415/53 R; 415/DIG. 1

[58] Field of Search ..... 415/219 R, 219 C, 181, 415/172 A, DIG. 1, 170 R

[56] References Cited

U.S. PATENT DOCUMENTS

| | | | |
|---|---|---|---|
| 3,893,782 | 7/1975 | Pierpoline et al. | 415/119 |
| 4,063,742 | 12/1977 | Watkins, Jr. | 415/172 A |
| 4,086,022 | 4/1978 | Freeman et al. | 415/119 |
| 4,116,584 | 9/1978 | Bammert et al. | 415/199.5 |
| 4,212,585 | 7/1980 | Swarden et al. | 415/53 R |
| 4,466,772 | 8/1984 | Okapuu et al. | 415/172 A |
| 4,540,335 | 9/1985 | Yamaguchi et al. | 415/172 A |

FOREIGN PATENT DOCUMENTS

| | | | |
|---|---|---|---|
| 42817 | 12/1971 | Japan | 415/DIG. 1 |
| 273364 | 10/1970 | U.S.S.R. . | |
| 478957 | 10/1975 | U.S.S.R. . | |

OTHER PUBLICATIONS

Wenzel et al., "Effect of Casing Treatment on Performance of a Multistage Compressor", Jan. 1975; (NASA).

Takata et al., "Study on the Mechanism of Stall Margin Improvement of Casing Treatment", Nov. 22, 1974; (ASME).

Horlock et al., "Propagating Stall in Compressors With Porous Walls", Dec. 2, 1974; (ASME).

Fabri et al., "Effect of Outer Casing Treatment and Tip Clearance on Stall Margin of a Supersonic Rotating Cascase", Dec. 2, 1974; (ASME).

Holman et al., "Effects of Casing Treatment on a Small, Transonic Axial-Flow Compressor", Jul. 23, 1975; (ASME).

*Primary Examiner*—Abraham Hershkovitz

*Assistant Examiner*—John T. Kwon

*Attorney, Agent, or Firm*—Sixbey, Friedman, Leedom & Ferguson

[57] ABSTRACT

A compressor having either an axial or radial stage adjacent the air inlet includes a circumferential row of slots in the inner casing wall, the slots opening into the casing bore; a rotor having a leading row of compressor blades thereon rotatable within the bore with the tips of the blades adjacent the row of slots; and, the axial centerline of the circumferential row of slots being positioned axially forward of the axial centerline of the blades of the leading blade row with a substantial portion of the axial slot length of each slot being forward of the leading edge of the blades of the leading blade row. In a preferred form of the compressor, the inner casing wall includes a circumferential stationary ring having an inner wall for defining with the inner casing wall the bore in which the rotor rotates, the circumferential row of slots being formed in the ring wall.

16 Claims, 9 Drawing Sheets

COMPRESSOR RANGE IMPROVEMENT MEANS

DESCRIPTION

1. Technical Field

The present invention relates to axial and radial flow compressors and, more particularly, to means for improving the range or map width of such compressors.

2. Background Art

Compressors typically comprise an impeller wheel, carrying a plurality of blades or vanes, mounted on an axis for rotation within a stationary housing. Rotation of this impeller wheel causes a gas, usually air, to be drawn into the impeller wheel and to be discharged to or through passages for transferring the compressed gas to its destination. In the case of a radial or centrifugal compressor, the gas is discharged centrifugally. In the case of an axial compressor, the gas is discharged axially. In a multi-stage compressor, a number of compressors, e.g., axial, centrifugal, or both, are connected in series so that the outlet from one compressor leads to the inlet of the next compressor in the series.

Compressors are frequently used in internal combustion engines, especially as a part of turbocharger units installed on such engines for improving the output power thereof by increasing the air flow charge to the cylinders to support increased fuel charge. These turbocharger units typically include a turbine operatively connected to the engine exhaust gas manifold, a compressor operatively connected to the engine air intake manifold, and a shaft connecting the turbine and compressor so that rotation of the turbine wheel causes rotation of the compressor impeller. The turbine is driven to rotate by the exhaust gas flowing in the exhaust manifold. The compressor impeller is driven to rotate by the turbine and, as it rotates, increases the air mass flow rate, air flow density and air pressure delivered to the engine cylinders.

In attempting to adapt and/or optimize available compressors for use on turbocharger assemblies suitable for various type internal combustion engines, rather than design totally new compressors, the problem most frequently encountered is that the available compressors have insufficient map width, i.e., the operating range of the compressors is too narrow to satisfy the air requirements of the particular engine while, at the same time, operating efficiently under the speed (rpm) conditions imposed by the engine. Typically, this has resulted in engine manufacturers offering narrowing speed range engines than would otherwise be desirable. Alternatively, in some instances, where available and practical, greater capacity, albeit more expensive, compressors are employed.

There have been efforts to develop compressors having improved operating ranges. For example, in U.S. Pat. No. 4,116,584, Bammert et al. disclose a means for increasing the working range of axial flow compressors by including in the compressor a ring of airfoil cross-section which is arranged concentrically to the compressor axis. The ring is positioned upstream of the rotor blades and downstream of the stator blades and, together with the inner wall of the compressor casing, defines an annular flow channel through the compressor. In U.S. Pat. No. 4,086,022, Freeman et al. disclose a compressor casing treatment for increasing the surge margin of a compressor, thereby allowing compressor flow and pressure ratio to be safely increased from normal operating conditions before reaching surge conditions. According to Freeman et al., a circumferential row of slots is provided in the internal casing wall adjacent at least one stage of compressor blade tips. The slots have an aerodynamically concave shape to their radially outermost wall, are inclined to the axis of rotation of the blades, and are arranged at an angle to a radial line through the casing center. Moreover, the slots have an axial length greater than the length of the blade row and are positioned such that the slots terminate downstream of the blade row with the axial centerline of the slots axially rearward of the axial centerline of the blades. Such an arrangement, it has been found, may provide an increase in compressor range but does so only at the expense of a significant loss in compressor efficiency.

It is, therefore, a primary object of the present invention to overcome the problem posed by the narrow operating range of available compressors and to provide a compressor configuration suitable for use as the compressor component of internal combustion engine turbochargers which can be readily and inexpensively incorporated into already available compressors to provides a wider usable map width without any significant loss in compressor efficiency.

DISCLOSURE OF THE INVENTION

In one aspect of the present invention this is accomplished by providing a single or multi-stage compressor having either an axial or radial compressor stage adjacent the compressor air inlet. A circumferential row of slots is provided in the inner cylindrical wall of the compressor casing which opens into the cylindrical bore thereof, the radially inward ends of the slot walls being generally parallel to the axis of the bore and the slot walls forming an angle of 50°–70° with a radius of the casing at the inner cylindrical casing wall. A compressor rotor is provided within the casing having at least one row of blades comprising the leading row of blades on the rotor for rotating within the casing bore about the axis thereof with the blade tips of the leading row of blades adjacent the circumferential row of slots, the slots being inclined with respect to the direction of blade rotation such that the rotating blades tend to force air into the slots. The circumferential row of slots is positioned relative to the blades such that the axis centerline of the slots is axially forward of the axial centerline of the leading row of blades on the rotor.

In another respect of the invention each slot comprises a pair of circumferentially spaced apart side walls and an end wall, the side walls defining at the inner cylindrical casing wall an axially and circumferentially extending, generally rectangular opening into the bore of the casing, the inclination of the slot walls relative to a casing radius causing the slots to be inclined relative to the inner casing wall at such an angle that the rotating blades tend to force air into the slots.

In still another aspect of the present invention the axial length of each slot is approximately equal to the projected axial length of the blades; the slot height, comprising the circumferential distance between adjacent slot walls, is approximately equal to the maximum blade thickness at the outermost diameter of the blade; and, the slots are circumferentially equally spaced apart.

In yet another aspect of the invention, the axial centerline of the slots is positioned axially forward of the axial centerline of the leading row of blades on the rotor between the axial centerline and the leading edge of the blades such that at least a portion of the slots is axially forward of the leading edge of the leading row of blades on the rotor.

BRIEF DESCRIPTION OF THE DRAWINGS

The invention will be better understood from the following description taken in conjunction with the accompanying drawings in which.

FIGS. *7a* and *7b* are enlarged sectional views showing the axial positioning relationship between the rotor blades and the slotted ring of FIGS. 3–6.

Figure 8:
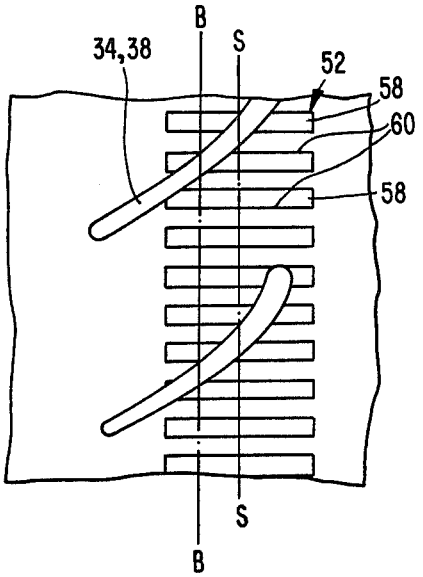

FIG. 8 is a sectional view taken substantially along line 8—8 in FIG. *7a*.

Figure 9:
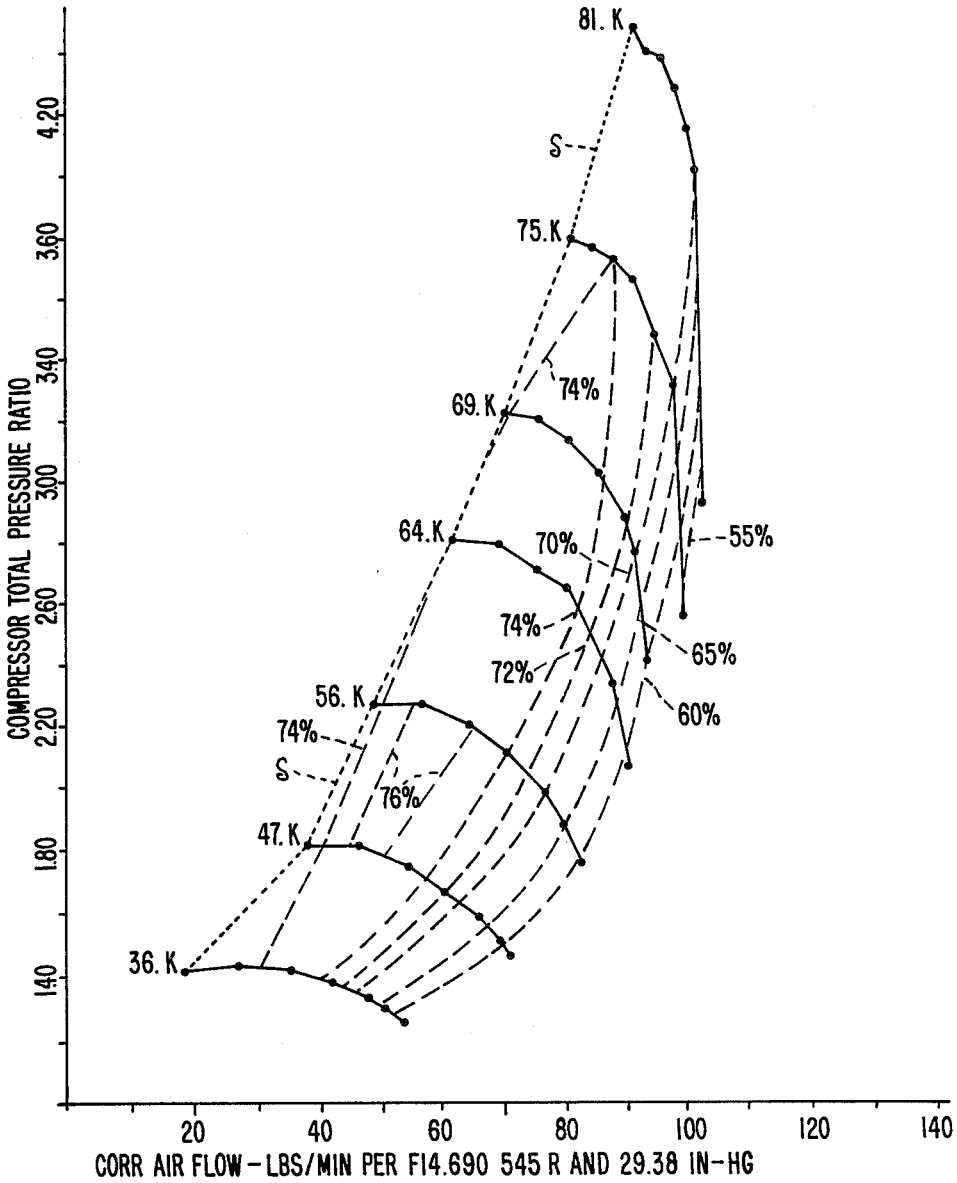

FIG. 9 is a graph of pressure ratio against mass flow for an axial compressor stage which does not include the compressor range improving means of the present invention.

FIGS. 10–13 are graphs of pressure ratio against mass flow for axial compressor stages incorporating the compressor range improving means of the present invention.

BEST MODE FOR CARRYING OUT THE INVENTION

Figure 1:
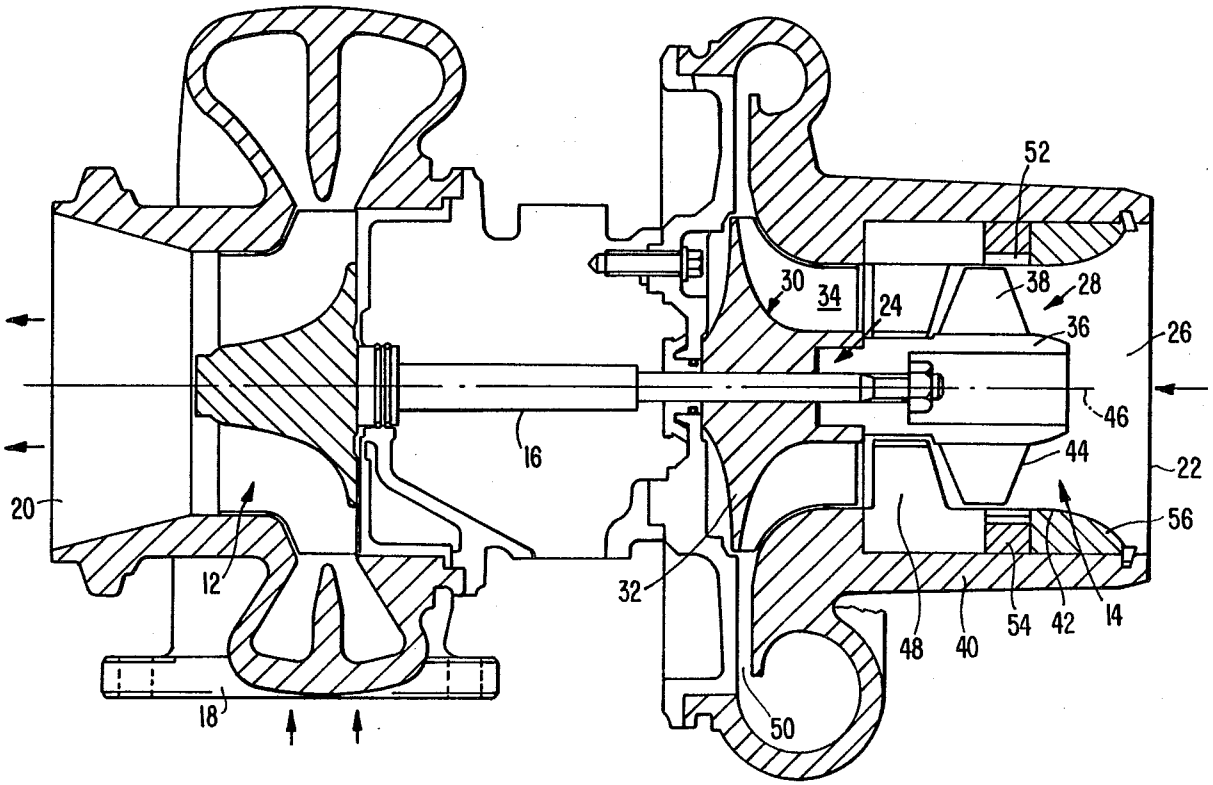
FIG. 1 is a fragmentary, sectional view, partly in elevation, of a multi-stage axial-radial compressor, forming a part of a turbocharger unit, the axial stage of the compressor being most closely adjacent the compressor inlet and incorporating the compressor range improving means of the present invention.

Referring to FIG. 1, there is shown a sectional view of a turbocharger 10 for an internal combustion engine. Turbocharger 10 includes turbine 12 and compressor 14 which are connected to each other by means of rotor shaft 16. Turbine 12 is positioned within exhaust manifold 18 so that it may be driven to rotate by the engine exhaust gas flowing therein. The exhaust gases are released from exhaust manifold 18 through exhaust gas outlet 20. Compressor 14 is located within intake air manifold 22 so that, as compressor rotor 24 is driven to rotate by turbine 12 via rotor shaft 16, it will increase air mass flow rate, pressure and density of the uncompressed air drawn through air inlet 26 prior to delivering the air to the engine.

Compressor 14 has an axial stage 28 proximate air inlet 26 and a centrifugal or radial stage 30 downstream of axial stage 28. The rotor shaft 16 carries compressor rotor 24, which includes impeller wheel 32, attached thereto, including a plurality of radial vanes or blades 34 thereon, and axial rotor 36, also attached thereto, having a row of axial compressor blades 38 thereon. A compressor casing 40 is arranged radially outwardly of axial-radial compressor 14 and includes an inner, generally cylindrical wall 42 defining a cylindrical bore 44 in which rotor shaft 16 rotates about bore axis 46. A plurality of stator blades 48 extend from casing wall 42 into bore 44 downstream of axial compressor blades 38 and upstream of impeller wheel 32 and its blades 34. In operation, rotation of turbine 12 causes rotation of impeller wheel 32, axial rotor 36, and their associated blades, and this causes uncompressed air to be drawn through air inlet 26 by and past the rotating blades of the axial stage 28, in which it is initially compressed. The compressed air then passes to radial stage 30 in which it is further compressed by impeller wheel 32 and blades 34 before it is directed to its ultimate destination; e.g., the cylinders of an internal combustion engine, via passageway 50.

Figure 2:
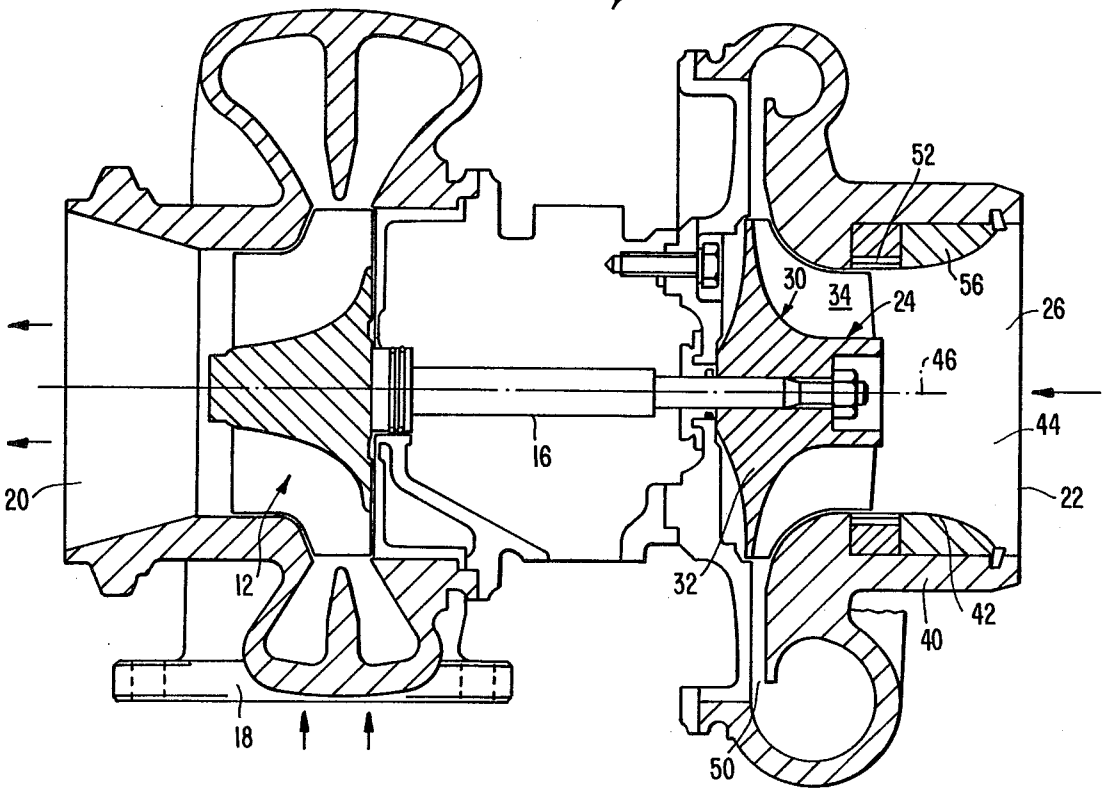
FIG. 2 is a fragmentary, sectional view, partly in elevation, of a single stage radial compressor forming a part of a turbocharger unit, the radial compressor incorporating the compressor range improving means of the present invention.

In the embodiment of FIG. 1, the uncompressed air is drawn through the air inlet 26 into axial compressor stage 28 wherein axial blades 38, arranged in conventional manner in a circumferential row about axial rotor 36, comprise the leading row of blades on rotor 24. In the embodiment of FIG. 2, there is also shown a sectional view of a turbocharger 10, as in FIG. 1, except that compressor 14 in FIG. 2 comprises only a centrifugal (radial) compressor having no axial stage. Uncompressed air drawn through air inlet 26 by rotation of impeller wheel 32 is compressed by impeller wheel 32 and radial blades 34 thereon. Unlike typical axial compressor stages, radial compressor stages frequently have two or more circumferential blade rows on the impeller wheel with successive blade rows spaced axially rearwardly (in the direction away from air inlet 26) of the immediately preceding blade row. For purposes of illustrative and descriptive simplicity, only one circumferential row of radial blades 34 is illustrated in FIG. 2 on impeller wheel 32 and this row 34 comprises the leading row of blades on rotor 24.

Figure 3:
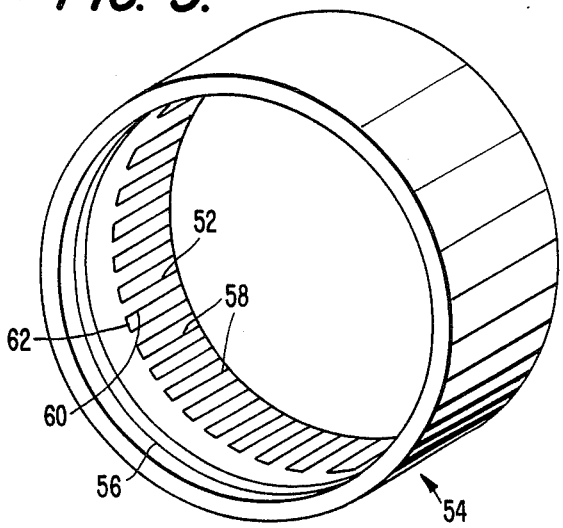
FIG. 3 is a perspective view of a slotted ring comprising one form of compressor range improving means of the present invention.
Figure 5:
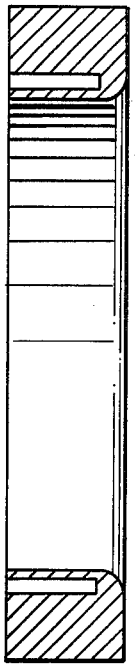
FIG. 5 is a sectional view taken along line 5—5 in FIG. 4.
Figure 4:
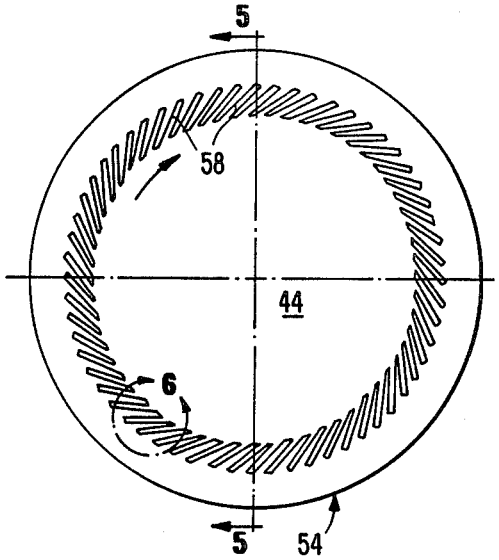
FIG. 4 is a plan view of the ring of FIG. 3.
Figure 6:
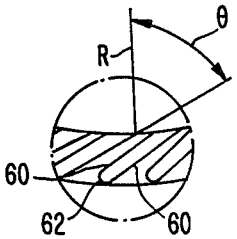
FIG. 6 is an enlarged view of the circled portion in FIG. 4.
Figure 7A:
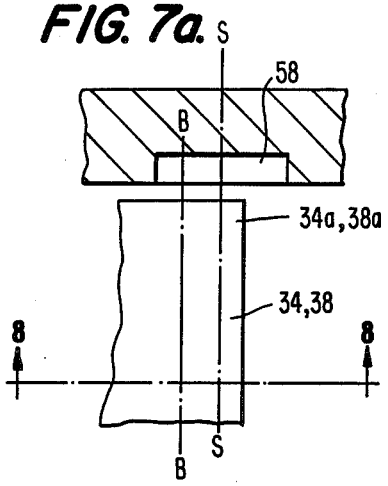
Figure 7B:
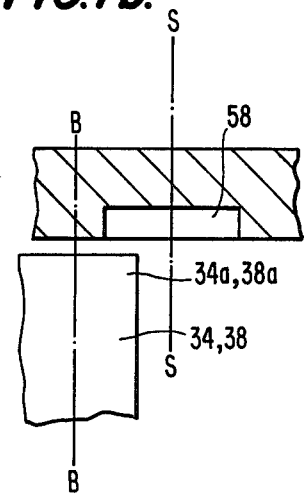

With reference to FIGS. 1–8, a circumferential row of slots 52 is provided in inner cylindrical casing wall 42 surrounding the leading row of blades on rotor 24. In the mixed axial-radial compressor of FIG. 1, the leading row of blades are axial blades 38, whereas in the centrifugal compressor of FIG. 2, the leading row of blades are radial blades 34. As shown in FIGS. 3–5 the circumferential row of slots 50 is most simply provided via a circumferential slotted stationary ring 54 having an inner cylindrical bore and inner diameter corresponding to the bore and inner diameter of the compressor casing 40. Ring 54, together with the inner wall 42 of compressor casing 40, defines bore 44 comprising an annular flow channel through the compressor 14. Slotted ring 54 desirably includes a tapered or graduated air inlet portion 56 for facilitating the smooth intake of uncompressed air into the compressor. As rotor 24 rotates, the tips 34*a*, 38*a* of the leading row of blades 34, 38 thereon pass immediately adjacent the circumferential row of slots 52.

With particular reference to FIGS. 3–6, it can be seen that each slot 58 of the circumferential row of slots 52 comprises a pair of circumferentially spaced apart side walls 60 and an end wall 62. The side walls 60 extend from the end wall 62, which is the radially outermost boundary of slot 58, inwardly toward cylindrical bore 44 at such an angle that the intersection of each side wall 60 with a radius, "R", of the bore 44 extending from bore axis 46 to the point of intersection at inner casing wall 42 forms an angle, "$\theta$", of 50°–70°, desirably 60°. It will be appreciated therefore, that although adjacent side walls 60 are substantially parallel, in order that each side wall forms the same angle with the radius, "R", they cannot in fact be parallel to each other. The side walls 60 terminate at the inner casing wall 42 and define between adjacent side walls a generally rectangular slot 58 opening into and communicating with bore 44. At the inner casing wall 42, the side walls extend in axial direction which is generally parallel to bore axis 46. The axial length of each slot 58 corresponds to the axial length of side walls 60. The height of each slot 58 corresponds to the circumferential spacing between side walls 60. Due to their inclination relative to bore radius, "R", the slots 58 are inclined relative to the inner casing wall 42 at such an angle that the rotating leading row of blades 34, 38 tends to force air into the slots. Thus, as can be seen in FIG. 4, the leading row of blades rotate clockwise (looking into an air inlet 26), as shown by the arrow, and tend to force air into slots 58 which are arranged and open into bore 44 in the manner and direction shown to facilitate receiving the air.

Although the dimensions of the slots may vary depending upon the particular compressor configuration and intended usage, there are particularly desirable dimensional relationships that appear to enhance the broadening of compressor map width without significant loss of efficiency, which is one primary goal of this invention. In the interest of consistency, when dimensions are discussed herein, the term "length" refers to a dimension along or parallel to bore axis 46; the term "width" refers to a dimension which extends generally radially relative to bore axis 46; and, the term "height" refers to a dimension which extends circumferentially. Thus, it is desirable that the slots 58 are uniformly spaced about the circumference of the casing and that all of the slots have the same slot height, i.e., circumferential spacings between adjacent slot walls 60. It is particularly preferred that the slots 58 and the side wall partition therebetween be of equal circumferential dimension, i.e., that the slot height equal the side wall height, and further, that this height be equal, within plus or minus 20%, to the maximum thickness, at their outermost diameter, of the blades of the leading row. It is also particularly desirable that the actual length of the slots be equal, within plus or minus 20%, to the projected length of a blade of the leading row. The projected length of the blade is the maximum axial length of the shadow which is cast by the outermost diameter of the blade upon a hypothetical axially extending screen positioned adjacent the casing wall between the blade and the casing wall when light is directed onto the blades from a diametrically opposite position along the casing wall in a direction perpendicular to bore axis 46. The width of the slots 58 measured as the distance along the longest side wall 60 of each slot between end walls 62 and inner casing wall 42 is desirably 5 to 10 times the height of the slot.

The positioning of the circumferential row of slots 52 relative to the leading row of blades on rotor 24 is essential to achieving the desired increase in map width or compressor range without significant, if any, loss in efficiency. According to the present invention the axial centerline of the slot length, which is the axial centerline of the circumferential row of slots, is positioned axially forward (toward air inlet 26) of the axial centerline of the blades of the leading row of blades 34, 38 on rotor 24. The axial centerline of the slot length may be positioned between the axial centerline of the blades and the leading edge of the leading row of blades, at the leading edge of the leading row of blades or axially forward of the leading edge of the leading row of blades, the optimum positioning depending upon factors, such as compressor configuration, slot configuration, engine requirements and desired map width adjustment. Particularly, in radial compressors, it has been found to be advantageous to position the axial centerline of the slot length in an axial position corresponding to the leading edge of the leading row of blades. Exemplary slot positioning is most clearly shown in FIGS. *7a*, *7b* and 8 wherein the slot centerline is designated S—S and the blade centerline is designated B—B.

It will be appreciated that as the slot centerline moves axially forward toward air inlet 26, more and more of the slot length is axially forward of the leading edge of the blades of the leading row. When the slot centerline is positioned to correspond to the leading edge of the blades, fully half the slot length is disposed axially forward of the leading edge. Although the mechanism is not fully understood by which this axial positioning of the circumferential row of slots contributes to increases compressor map width without signficant loss in compressor efficiency, it may be that the slots aid in transmitting air flow and, thus, pressure from the foreward to the back side of the blades, with the result of the abrupt changes in pressure are eliminated. Whatever the actual mechanism, the effect on compressor range and efficiency is undeniable, as can be seen from a study of FIGS. 9–13.

FIG. 9 is a map or graph of pressure ratio against mass flow for engine speeds of from 36,000 rpm to 81,000 rpm for a two-stage compressor, as shown in FIG. 1, which has an axial first stage and a radial second stage but which omits the circumferential row of slots of the present invention. The dashed lines connect points of equal compressor efficiency. The surge line, denoted S in FIG. 9, is shown as a dotted line. Typically, in increasing the map width or range of a compressor, it is desirable to move the surge line to the left, toward lower mass flow. This can be achieved by use and positioning of the circumferential row of slots in accordance with the present invention.

Figure 10:
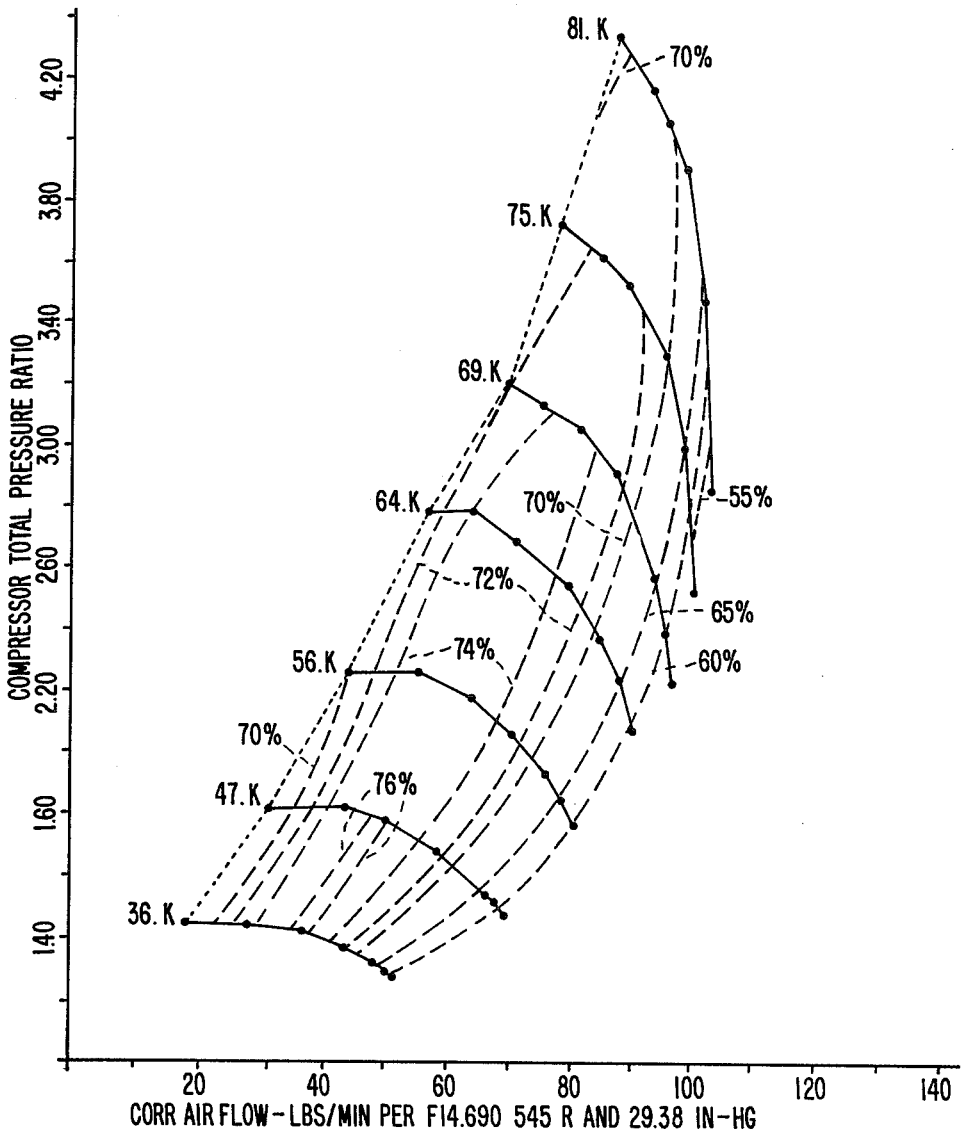

FIG. 10 illustrates a map for the same compressor as in FIG. 9 except that a circumferential slotted ring, as shown in FIGS. 3–5, was positioned in the casing adjacent the leading row of axial blades. The ring had an OD of 4.475 inches and an ID of 3.256 inches, was formed of 60 equally spaced apart slots having a slot height of 0.05 inches, a slot width of 0.375 inches and a slot length of 0.800 inches and was positioned in the casing with the slots centered axially along the adjacent row of axial compressor blades 38, i.e., with the slot centerline positioned to axially correspond to the centerline of the axial blades. It can be seen from FIG. 10 that a significant increase in range, i.e., map width, occurred, albeit with a loss in efficiency. For example, note that the surge line at 47K moved from an air flow of about 38 lbs/min without the slotted ring to a flow of about 32 lbs/min with the 0.8 inch wide ring. Likeiwse, the surge line at 56K moved from about 49 lbs/min without the ring to about 44 lbs/min with the ring and at 64K moved from about 60 lbs/min to about 55 lbs/min. At the same time, the islands enclosed by each of the 76%, 74%, 72%, etc., efficiency lines decreased significantly in size in operation with the circumferential slotted ring in place (FIG. 10) as contrasted with operation without the ring (FIG. 9), indicating a marked decrease in compressor efficiency.

Figure 11:
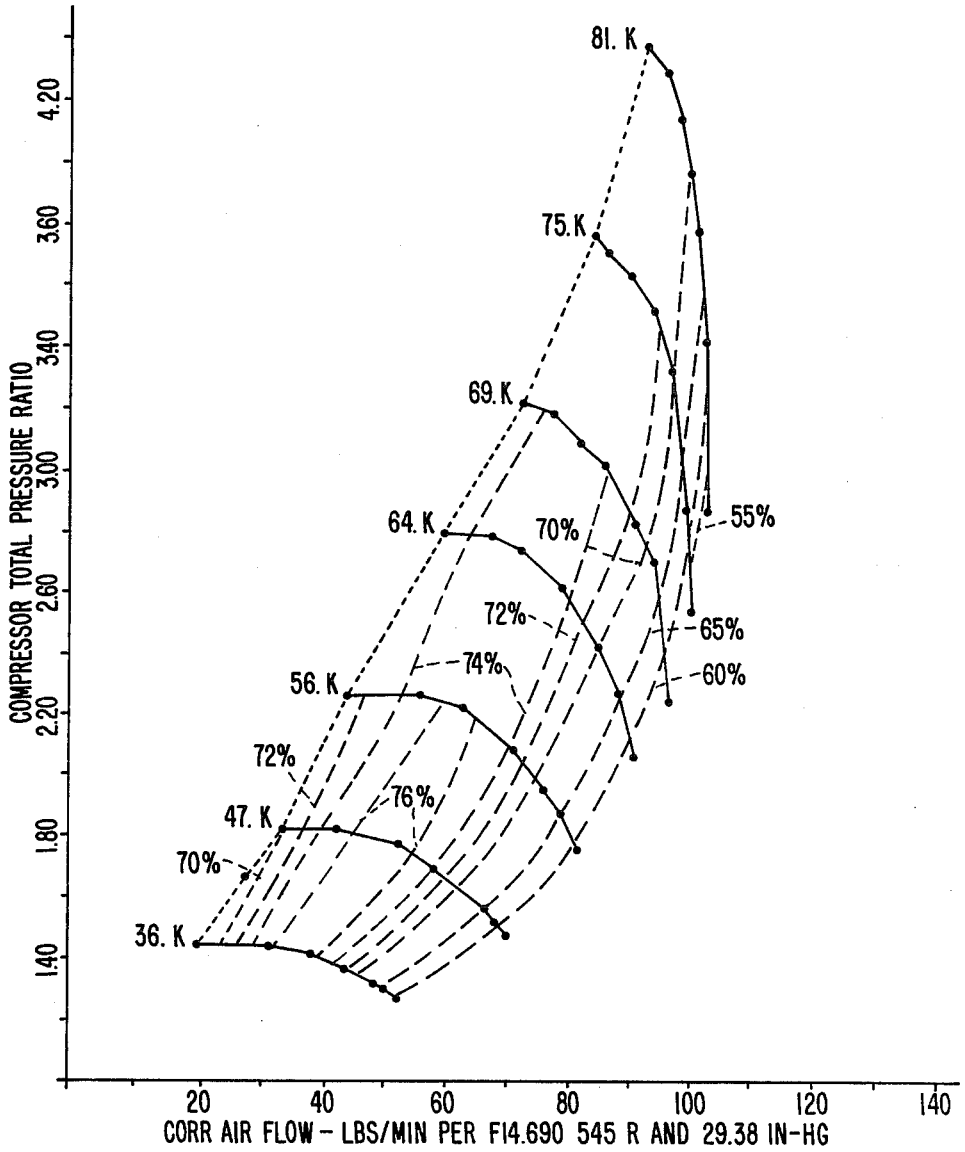

FIG. 11 illustrates a map for the same compressor and slotted ring as in FIG. 10 except that the circumferential slotted ring had a slot length of 0.5 inches instead of 0.8 inches. Use of the narrower ring resulted in a lesser improvement in map width compared to use of the wider ring. Compare, for example, the surge line flow line in FIGS. 11 and 10, respectively, at 47K (34 vs. 32 lbs/min), at 56K (46 vs. 44 lbs/min) and at 64K (60 vs. 55 lbs/min). It also resulted in less efficiency loss as can be seen from a comparison of the size of the 76%, 74%, 72%, etc., efficiency islands.

Figure 12:
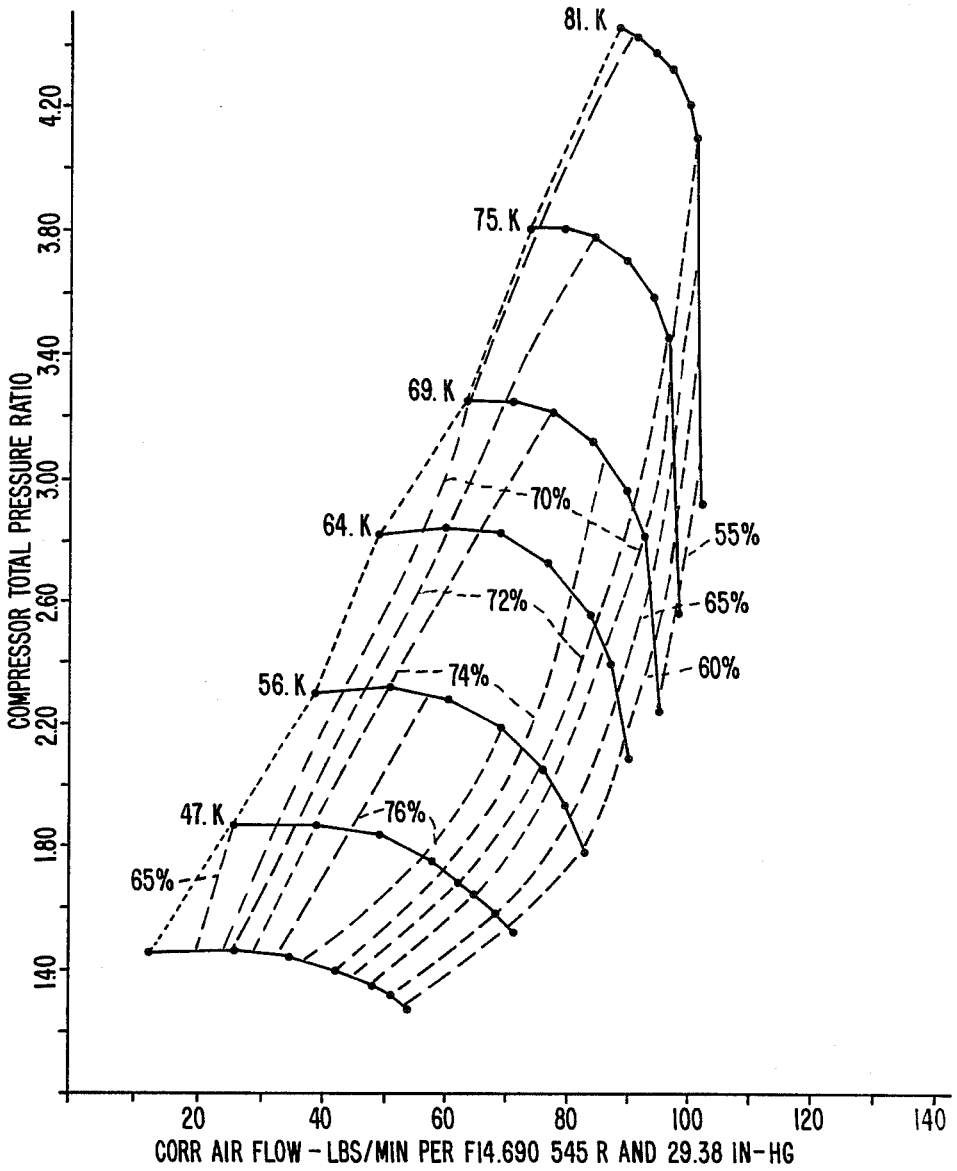
Figure 13:
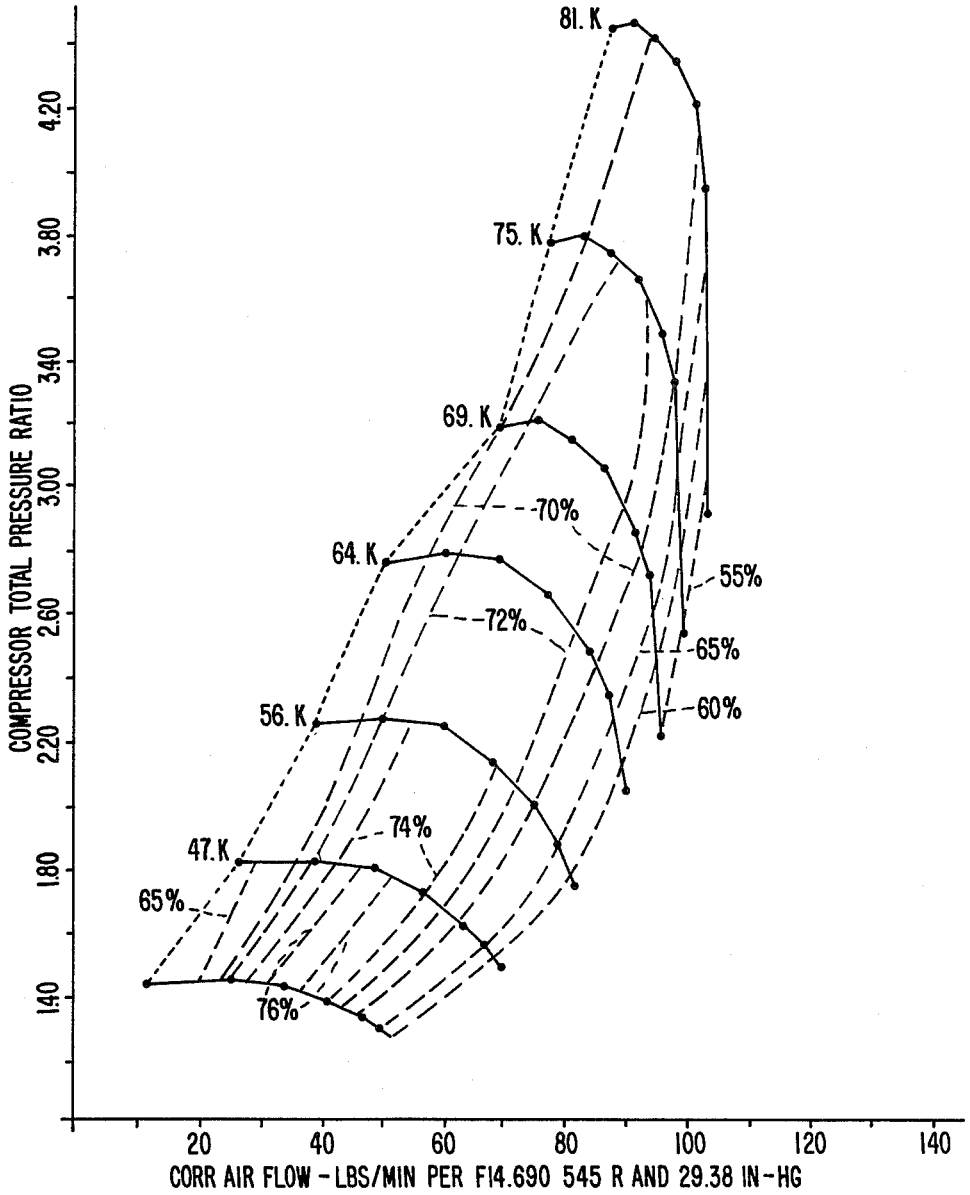

In FIGS. 12 and 13, the same compressor and slotted ring as in FIGS. 10 and 11 were used except that in FIG. 12 the slot length was 0.5 inches and in FIG. 13 the slot length was 0.6 inches. The major difference between the compressor configuration for the operations illustrated in FIGS. 12 and 13 compared with the operations illustrated in FIGS. 10 and 11 is that in FIGS. 12 and 13 the slot centerline was positioned 0.355 inches forward, toward air inlet 26, of the centerline of the leading row of blades. Thus, in both instances the entire slot length was forward of the blade centerline. It is apparent from each of FIGS. 12 and 13 that the increase in map width occasioned by the positioning of the slot axially forward of the blade centerline was very significant with the surge line in each case moved a considerable distance toward the left (toward lower air flow rates). Thus, it can be seen from FIGS. 12, 13 compared with compressor operation with no slotted ring, FIG. 9, at 47K, 56K, and 64K that there is more than ten pounds of surge margin gained with no loss of choke flow or efficiency by utilizing the circumferential slotted ring of the present invention and positioning it axially forward of the blade centerline. Compare, for example, at each engine rpm value the air flow values for operations depicted in FIG. 9 (no ring) and FIGS. 12, 13:

| | FIG. 9 | FIG. 12 | FIG. 13 |
|---|---|---|---|
| 47K: | 38 | 26 | 27 |
| 50K: | 50 | 38 | 38 |
| 64K: | 60 | 47 | 49 |

Industrial Applicability

The unique and improved compressor configuration of the present invention, comprising a circumferential row of slots provided in the casing wall positioned with the axial centerline of the slots axially forward of the centerline of the leading row of blades on the rotor, significantly improves map width and surge margin and is broadly useful on both axial and radial compressors. The invention has particular applicability to the compressor components of turbocharger assemblies used in connection with all types of internal combustion engines.

It is important that the slots define a plurality of openings into the annular bore circumscribed by the inner casing wall and that the slots are inclined relative to the inner casing wall at such an angle that the rotating leading row of compressor blades tends to force air into the slots. This orientation together with the positioning of the slots such that their axial centerline is axially forward of the axial centerline of the leading row of blades allows the slots to function in an effective manner to significantly improve compressor map width and, thereby, to allow the adaptation of available compressors to use on turbocharger assemblies with internal combustion engines having widely differing air and speed requirements.

We claim:

1. A compressor comprising:

a compressor casing having an inner cylindrical casing wall defining a generally cylindrical bore and a central axis of rotation therethrough and including a circumferential row of slots formed in said inner casing wall;

a rotor having a compressor blade row comprising the leading row of blades on sid rotor, said leading blade row comprising a plurality of blades rotatable about said axis within said bore with the tips of said blades adjacent said row of slots;

each slot of said circumferential row of slots defined by an end wall and a pair of circumferentially spaced apart side walls, said side walls extending from said end wall toward said inner casing wall and defining therebetween at said inner casing wall an axially elongate opening into said bore, said side walls at said inner casing wall being generally parallel to the axis of said bore and forming at said inner casing wall an angle of 50°–70° with a radius of said bore extending from said axis, the inclination of said side walls causing said slots to be inclined relative to said inner casing wall at such an angle that the rotating blade tends to force air into said slots, and the axial length of each said slot being equal, within plus or minus 20%, to the maximum projected axial length of the blades of said leading row of blades on said rotor;

the axial centerline of said circumferential row of slots being positioned axially forward of the axial centerline of the blades of said leading blade row and a substantial portion of the axial slot length of each slot being forward of the leading edge of the blades of said leading blade row.

2. A compressor comprising:

a compressor casing having an inner cylindrical casing wall defining a generally cylindrical bore and a central axis of rotation therethrough and including a circumferential row of slots formed in said inner casing wall;

a rotor having a compressor blade row comprising the leading row of blades on said rotor, said leading blade row comprising a plurality of blades rotatable about said axis within said bore with the tips of said blades adjacent said row of slots;

each slot of said circumferential row of slots defined by an end wall and a pair of circumferentially spaced apart side walls, said side walls extending from said end wall toward said inner casing wall and defining therebetween at said inner casing wall an axially elongate opening into said bore, said side walls at said inner casing wall being generally parallel to the axis of said bore and forming at said inner casing wall an angle of 50°–70° with a radius of said bore extending from said axis, the inclination of said side walls causing said slots to be inclined relative to said innwer casing wall at such an angle that the rotating blades tend to force air into said slots, and the height of each said slot being equal, within plus or minus 20%, to the maximum thickness, measured at their outermost diameter, of the blades of said leading row of blades on said rotor;

the axial centerline of said circumferential row of slots being positioned axially forward of the axial centerline of the blades of said leading blade row and a substantial portion of the axial slot length of each slot being forward of the leading edge of the blades of said leading blade row.

3. A compressor comprising:

a compressor casing having an inner cylindrical casing wall defining a generally cylindrical bore and a central axis of rotation therethrough and including a circumferential row of slots formed in said inner casing wall;

a rotor having a compressor blade row comprising the leading row of blades on said rotor, said leading blade row comprising a plurality of blades rotatable about said axis within said bore with the tips of said blades adjacent said row of slots;

each slot of said circumferential row of slots defined by the end wall and a pair of circumferentially spaced apart side walls, said side walls extending from said end wall toward said inner casing wall and defining therebetween at said inner casing wall an axially elongate opening into said bore, said side walls at said inner casing wall being generally parallel to the axis of said bore and forming at said inner casing wall an angle of 50°–70° with a radius of said bore extending from said axis, the inclination of said side walls causing said slots to be inclined relative to said inner casing wall at such an angle that the rotating blades tend to force air into said slots, and the width of each said slot measured along the longest side wall of said slot between said slot end wall and said inner casing wall being 5 to 10 times the height of said slot;

the axial centerline of said circumferential row of slots being positioned axially forward of the axial centerline of the blades of said leading blade row and a substantial portion of the axial slot length of each slot being forward of the leading edge of the blades of said leading blade row.

4. A compressor comprising:

a compressor casing having an inner cylindrical casing wall defining a generally cylindrical bore and a central axis of rotation therethrough and including a circumferential row of slots formed in said inner casing wall;

a rotor having a compressore blade row comprising the leading row of blades on said rotor, said leading blade row comprising a plurality of blades rotatable about said axis within said bore with the tips of said blades adjacent said row of slots;

each slot of said circumferential row of slots defined by an end wall and a pair of circumferentially spaced apart side walls, said side walls extending from said end wall toward said inner casing wall and defining therebetween at said inner casing wall an axially elongate opening into said bore, said side walls at said inner casing wall being generally parallel to the axis of said bore and forming at said inner casing wall an angle of 50°–70° with a radius of said bore extending from said axis, the inclination of said side walls causing said slots to be inclined relative to said inner casing wall at such an angle that the rotating blades tend to force air into said slots; the angles formed at said inner casing wall between said side walls and the radii of said bore being equal; the axial length of each said slot being equal, within plus or minus 20%, to the maximum projected axial length of the blades of said leading blade row; the height of each said slot being equal, within plus or minus 20%, to the maximum thickness, measured at their outermost diameter, of the blades of said leading blade row; the width of each said slot measured along the longest side wall of said slot between said slot end wall and said inner casing wall being 5 to 10 times the height of said slot; and, said slots being uniformly spaced apart about the circumference of said inner casing wall;

the axial centerline of said circumferential row of slots being positioned axially forward of the axial centerline of the blades of said leading blade row and a substantial portion of the axial slot length of each slot being forward of the leading edge of the blades of said leading blade row.

5. A compressor, as claimed in claims 1, 2, 3, or 4, wherein said inner casing wall includes a circumferential, stationary ring having an inner cylindrical wall, the diameter of said ring inner wall corresponding to the diameter of said inner casing wall for defining with said inner casing wall said generally cylindrical bore within which said rotor rotates, said circumferential row of slots being formed in said ring inner wall.

6. A compressor, as claimed in claims 1, 2, 3, or 4, wherein said axial centerline of said circumferential row of slots is axially positioned at the leading edge of the blades of said leading blade row.

7. A compressor, as claimed in claims 1 or 2, wherein said axial centerline of said circumferential row of slots is positioned axially forward of the leading edge of the blades of said leading blade row.

8. A compressor, as claimed in claims 1, 2, 3, or 4, wherein at least one-half of the axial slot length of each slot is positioned axially forward of the leading edge of the blades of said leading blade row.

9. A compressor, as claimed in claims 1, 2, 3, or 4, wherein the entire axial slot length of each slot is positioned axially forward of the axial centerline of the blades of said leading blade row.

10. A compressor, as claimed in claim 5, wherein the angle formed by each side wall with a radius of said bore intersecting said side wall at the said inner casing wall is equal to the angle formed by each other side wall with a radius of said bore intersecting said each other side wall at said inner casing wall.

11. A compressor, as claimed in claim 5, wherein the angle formed at said inner casing wall between each side wall and a radius of the bore is about 60°.

12. A compressor, as claimed in claim 5, wherein said slots are uniformly spaced apart about the circumference of said inner casing wall.

13. A compressor, as claimed in claim 12, wherein each slot is spaced from its circumferentially adjacent slot by a partition and the height of each said slot is equal to the height of each said partition.

14. A compressor, as claimed in claim 13, wherein each said partition is defined by the adjacent side walls of circumferentially adjacent slots.

15. A compressor, as claimed in claim 5, wherein said ring includes a circumferential portion upstream of said row of slots for defining the air inlet to said casing, the inner diameter of said circumferential portion tapering from an inlet diameter greater than said bore diameter to a diameter equal to said bore diameter.

16. A compressor, as claimed in claim 8, wherein at least one-half of the axial slot length of each slot is positioned axially forward of the leading edge of the blades of said leading blade row.

* * * * *